US005162773A

United States Patent [19]

Shiozaki

[11] Patent Number: 5,162,773

[45] Date of Patent: Nov. 10, 1992

[54] HIGH BREAKING CAPACITY MICRO-FUSE

[75] Inventor: Masaaki Shiozaki, Kanagawa, Japan

[73] Assignee: SOC Corporation, Tokyo, Japan

[21] Appl. No.: 735,245

[22] Filed: Jul. 24, 1991

[30] Foreign Application Priority Data

Oct. 11, 1990 [JP] Japan ..... 2-105969[U]

[51] Int. Cl.[5] ..... H01H 85/02; H01H 85/38

[52] U.S. Cl. ..... 337/201; 337/231; 337/278; 337/282

[58] Field of Search ..... 337/201, 202, 186, 231, 337/247, 263, 273, 276, 278, 279, 280, 281, 282, 255, 234, 260

[56] References Cited

U.S. PATENT DOCUMENTS

| | | | |
|---|---|---|---|
| 4,511,875 | 4/1985 | Arikawa | 337/201 |
| 4,608,548 | 8/1986 | Borzoni | 337/231 |
| 4,630,022 | 12/1986 | Yuza | 337/282 |
| 4,894,633 | 1/1990 | Holtfreter | 337/278 |
| 4,920,327 | 4/1990 | Arikawa et al. | 337/231 |

FOREIGN PATENT DOCUMENTS

| | | |
|---|---|---|
| 396197 | 8/1933 | United Kingdom . |
| 811962 | 4/1959 | United Kingdom . |
| 1200702 | 7/1970 | United Kingdom . |
| 1200707 | 7/1970 | United Kingdom . |
| 2233512 | 1/1991 | United Kingdom . |

*Primary Examiner*—Harold Broome
*Attorney, Agent, or Firm*—Wenderoth, Lind & Ponack

[57] ABSTRACT

A high breaking capacity micro-fuse includes a body having a wall which forms a cavity in a body, pair of conductive terminals extending through the wall, and a fusible element extending between the pair of conductive terminals and connected thereto in the cavity. An insulating member with a hole through which the fusible element extends has a shape by which a space is provided between the inner surface of the wall of the body and the insulating member when the insulating member is disposed in the cavity of the body.

6 Claims, 1 Drawing Sheet

HIGH BREAKING CAPACITY MICRO-FUSE

BACKGROUND OF THE INVENTION

1. Field of the Invention

The present invention relates to a fuse for protecting components connected to an electric circuit against burning that may occur when abnormal overcurrent flows through the electric circuit.

Recently, there have been strong demands for the miniaturization of electronic apparatus. In order to meet these demands, the length of wiring of a circuit on a printed board tends to be rather small with charging sections having opposite polarities tending to be placed in close proximity to each other as well. Due to this, when compared with a case in which a conventional printed circuit board is used, a greater magnitude of abnormal current tends to flow once a short-circuit occurs.

In order to cope with this, smaller circuit protecting components also have been demanded, and the distance between terminals of such smaller circuit protecting components has been decreased. In cutting off abnormal current, there is a close relationship between the occurrence of arc discharge and the magnitude of abnormal current and/or the distance between the terminals. The greater the magnitude of abnormal current becomes, or the smaller the distance between the terminals becomes, the more easily longer arc discharge occurs. Arc discharge generates heat having a high temperature of several thousand degrees centigrade, and due to this there is a risk of the circuit protecting components themselves being burnt. Thus, cutting off the current becomes more and more difficult when trying to satisfy the demands for the miniaturization of circuit protecting components.

2. Prior Art

Conventionally, in a well known fuse of this type is well known an arc-extinguishing material is packed around a fusible element so as to extinguish a high-temperature arc that is generated after the fusible element has been fused by abnormal current.

In the fuse described above, since the arc-extinguishing material is brought into direct contact with the fusible element, the arc-extinguishing material abrades or cuts into the surface of the fusible element, whereby the fusible element is damaged. Thus, the fuse of this type has a drawback in that it mechanically breaks down due to the damage so caused. In addition, when the fusible element is fused by a great magnitude of current, the complete dispersion of metal vapors rising from the fused fusible element is prevented by the arc-extinguishing material surrounding the fusible element, preventing the creation of wide spaces between metal particles, and resulting in poor insulation. Thus, there is the risk of an arc discharge being caused again. Moreover, it is a very difficult operation to pack a particulate arc-extinguishing material into a small fuse's main body. Therefore, the productivity associated with the manufacturing process is low.

SUMMARY OF THE INVENTION

The present invention was made in view of the above drawback inherent in the prior art. So, the object thereof is to provide a reliable high breaking capacity micro-fuse capable of ensuredly breaking a great magnitude of current, as well as of maintaining a fusible element, used therein, free from damage when in proper operation.

In order to achieve this object, a high breaking capacity micro-fuse according to the present invention comprises an insulating body having a wall and a cavity defined by said wall in said body; a pair of conductive terminals extending outwardly from said cavity through said wall and being opposed to each other; a fusible element having opposite ends, one of said ends being mechanically and electrically connected to one of said pair of terminals within the cavity, said fusible element extending from said one of said pair of terminals to the other of said pair of terminals, the other of said ends of said fusible element being mechanically and electrically connected to said other of said pair of terminals within the cavity; and an insulating member having a hole which passes through said insulating member and through which said fusible extends, said insulating member having a shape by which a space is provided between the inner surface of said wall of said body and said insulating member with said insulating member being disposed in said cavity of said body.

The insulating member disposed in the cavity of the body functions to allow metal vapor, generated when the fusible element extending through the hole of the insulating member has been fused by an abnormal overcurrent flowing through the fusible element, to be released from the hole to the outer surface of the insulating member, and then to the inner surface of the wall of the body for dispersion, whereby the deposition density of metal vapors on the respective surfaces of the body and the insulating member is low, thereby making it possible to achieve a high insulation resistance.

DETAILED DESCRIPTION OF THE PREFERRED EMBODIMENT

Figure 1:
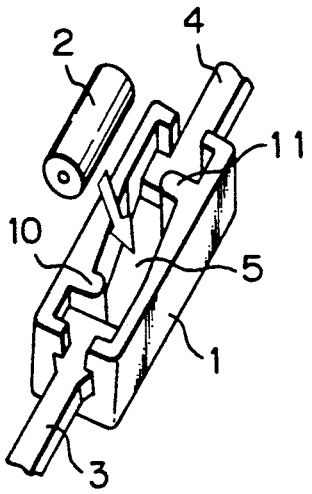
FIG. 1 is a perspective view of a fuse of the present invention before assembly.

Referring to the drawings, a preferred embodiment of the present invention will be described.

In FIGS. 1 to 5, a fuse's main body 1 is formed from a heat-resistant insulating material, such as ceramic, by embossing and baking the same material into a rectangular parallelepiped-shaped box which is 2 to 3 mm wide, 7 to 8 mm long, and 2 to 3 mm high with the thickness of the materiel ranging from 0.5 to 1 mm.

Particularly speaking, slots are formed in longitudinal ends of the box 1 so as to allow terminals 3, 4 to extend outwardly from the box 1. A fusible element 6 is fixed between these terminals 3, 4 inside the box 1, and the terminals 3, 4 are electrically connected to electric circuits outside the box 1, respectively.

Partition walls 10, 11 are provided internally at the longitudinal ends of the box so as to prevent the inward movement of the terminals 3, 4, as well as movement of a cylindrical tube 2 provided in the box.

Figure 2:
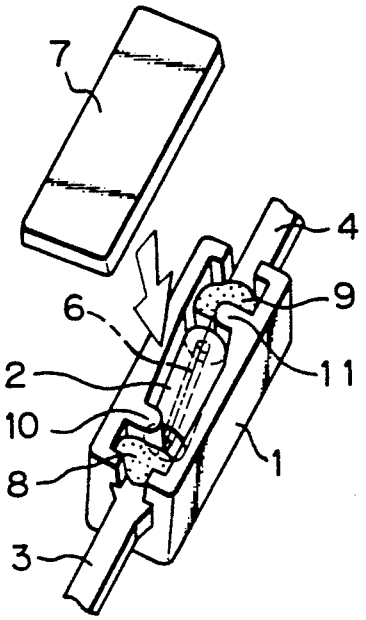
FIG. 2 is a perspective view of the same fuse in which components have been incorporated.

Solder-plated copper is used for the terminals 3, 4 and is press-formed into a T-shaped lead wire, so as to prevent the withdrawal of the lead wire longitudinally of the main body 1 once a T-shaped end thereof is placed in the box-shaped main body 1. A heat-resistant insulating material such as ceramic is used for the cylindrical tube 2, and this material is embossed and baked, so as to be formed into a cylindrical tube having an outside diameter of 1 mm and an inside diameter of 0.5 mm, and as shown in FIG. 2, this cylindrical tube 2 has a length allowing itself to just fit inside 5 of the box-shaped main body 1 after the fusible element 6 has been put therethrough.

Figure 3:
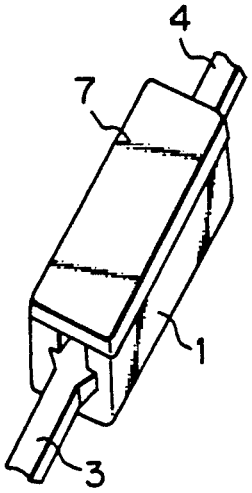
FIG. 3 is a perspective view of the fuse of the present invention which has been completely assembled.
Figure 4:
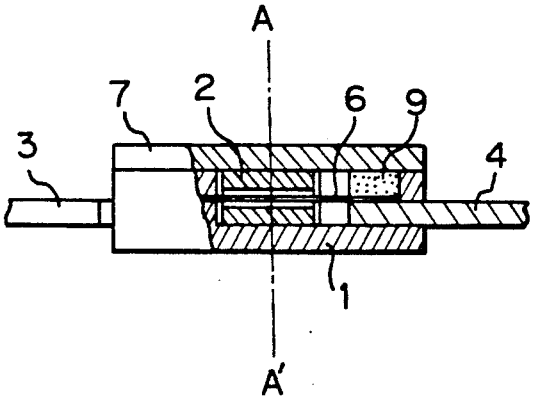
FIG. 4 is a longitudinal sectional view of the fuse of the present invention.

The fusible element 6 is fixed to the terminals 3, 4 at the ends thereof, respectively, by solder 8, 9. Afterwards, a lid 7, made from the same material as that of the box-shaped main body 1, is placed on the top of the box-shaped main body 1 so as to seal the upper opening thereof, whereby a micro-fuse having an external appearance as shown in FIG. 3 is completed.

Figure 5:
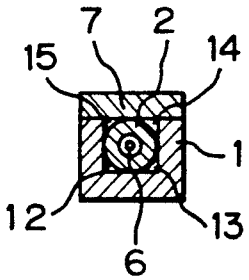
FIG. 5 is a cross-sectional view taken along the line A–A′ of FIG. 4.

Thus, as can be seen in FIG. 5, the cross-sectional shape of a cavity formed by the box-shaped main body 1 and the lid 7 placed thereon is rectangular, and spaces 12, 13, 14 and 15 are formed between the inner wall surface of the box-shaped main body 1, including the lid 7, and the outer surface of the cylindrical tube 2.

Even in the high breaking capacity micro-fuse as mentioned above, which has a simple construction in which the cylindrical tube with the fusible element extending therethrough is inserted in the box-shaped main body, it is possible to attain superior insulation resistance by allowing metal vapors to be dispersed into spaces 12, 13, 14 and 15 and to be absorbed by the inner wall surfaces of the box-shaped main body 1 and the lid 7, and the outer and inner surfaces of the cylindrical tube 2. It is also possible to obtain a performance good enough to securely break a great magnitude of current by means of an additional simple component such as a cylindrical tube 2 and simple assembling thereof. Moreover, there is no material surrounding the fusible element 6 in the cylindrical tube such as an arc-extinguishing material, and therefore the fusible element 6 is made free from restraint that would be imposed when an arc-extinguishing material is used. In addition, the surface of the fusible element 6 is also prevented from being abraded and damaged whereby any mechanical breakage is prevented, thereby making it possible to obtain a highly reliable fuse.

A comparison test, between the high breaking capacity micro-fuse according to the present invention and a conventional fuse using an arc-extinguishing material, was carried out. With the high breaking capacity micro-fuse of the present invention, a proper current breaking operation was performed without any difficulty under the short-circuit breaking test condition voltage of 125 V, short-circuit current 50 A and power factor of 0.7 which are stipulated under the overcurrent protection fuse standards UL198G. The micro-fuse exhibited a short-circuit breaking capacity performance similar to that of the fuse in which an arc-extinguishing material is used. Moreover, in a repeated overcurrent test, in which an exciting current equal to the rated current is repeatedly switched on and off for one second intervals in an alternate fashion, the conventional fuse in which an arc-extinguishing material is used was fused after it had been switched on and off eight hundred and fifty-two times, while the high breaking capacity fuse of the present invention managed to endure the repeated energizations of ten thousands times, without fusing.

As is clear from the above description, the high breaking capacity fuse according to the present invention has a superior performance.

It should be noted that in order to form a space or spaces between the inner wall surface of the main body 1 and the lid 7, and the outer surface of the tube 2, various cross-sectional shapes of the cavity formed by the main body 1 and the lid 7 placed on the top of various main body 1, and the cross-sectional shapes of the outer surface of the tube 2 may be employed, respectively. Moreover, it should be noted that the cylindrical tube 2 may consist of a plurality of cylindrical tubes which are disposed in series inside of the main body 1.

The present invention has been described in detail with reference to a certain embodiment thereof, but it will be understood that various modifications can be effected within the spirit and scope of the invention.

What is claimed is:

1. A high breaking capacity micro-fuse comprising:

an insulating body having a wall of heat and electrically insulative material defining a cavity in the body;

a pair of electrically conductive terminals extending into said cavity through the wall of said body to respective ends of the terminals, said ends of the terminals being spaced from one another in said cavity;

a fusible element extending between said terminals, one end of said fusible element being mechanically connected to one of said terminals in an electrically conductive relation therewith, and the other end of said fusible element being mechanically connected to the other of said terminals in an electrically conductive relation therewith; and an insulating member of heat and electrically insulative material discrete from said insulating body and disposed in said cavity thereof, said insulating member having an outer surface and defining a hole extending therethrough so as to be open at two locations on said outer surface, a relatively small part of the outer surface of said insulating member contacting the wall of sad insulating body in a manner which fixes said insulating member in said cavity, a remaining relatively large part of the outer surface of said insulating member being spaced from said insulating body with a vacant space being left between said insulating body and the remaining relatively large part of the outer surface of said insulating member, and said fusible element extending through the hole in said insulating member, whereby when said fusible element is fused, vapors emanating therefrom are dispersed over an inner surface of the wall of said insulating body defining said cavity, said relatively large part of the outer surface of said insulating member and an inner surface of said insulating member that defines said hole through which said fusible element extends.

2. A high breaking capacity micro-fuse as claimed in claim 1, wherein said insulating body and said insulating member are both of ceramics.

3. A high breaking capacity micro-fuse as claimed in claim 1, wherein said insulating body comprises a box-shaped portion having an opening therein, and a cover covering said opening so as to define said cavity with said box-shaped portion, said cavity has a rectangular cross section, said terminals are disposed at opposite longitudinal ends of the box-shaped portion of said insulating body, said insulating member is cylindrical, and said hole extends axially through the cylindrical insulating member.

4. A high breaking capacity micro-fuse as claimed in claim 3, wherein the box-shaped portion and the cover of said insulating body, and said insulating member are all of ceramics.

5. A high breaking capacity micro-fuse as claimed in claim 3, wherein said insulating member consists of a plurality of discrete cylindrical tubes disposed in series in said cavity.

6. A high breaking capacity micro-fuse as claimed in claim 3, wherein the box-shaped portion of said insulating body includes partition walls extending within said insulating body at the opposite longitudinal ends of said box-shaped portion, respectively, said insulating member being interposed between said partition walls such that said partition walls limit movement of said insulating member in the longitudinal direction of the box-shaped portion of said insulating body.

* * * * *